US011070009B2

(12) United States Patent
Lee et al.

(10) Patent No.: US 11,070,009 B2
(45) Date of Patent: Jul. 20, 2021

(54) JUNCTION CONNECTOR ASSEMBLY INTEGRATED WITH FUSE

(71) Applicants: HYUNDAI MOTOR COMPANY, Seoul (KR); KIA MOTORS CORPORATION, Seoul (KR); YURA CO., LTD, Hwaseong-si (KR)

(72) Inventors: Kwang-Moo Lee, Suwon-si (KR); Ho-Chul Ahn, Bucheon-si (KR)

(73) Assignees: HYUNDAI MOTOR COMPANY, Seoul (KR); KIA MOTORS CORPORATION, Seoul (KR); YURA CO., LTD, Hwaseong-si (KR)

( * ) Notice: Subject to any disclaimer, the term of this patent is extended or adjusted under 35 U.S.C. 154(b) by 0 days.

(21) Appl. No.: 16/675,467

(22) Filed: Nov. 6, 2019

(65) Prior Publication Data

US 2020/0185865 A1 Jun. 11, 2020

(30) Foreign Application Priority Data

Dec. 10, 2018 (KR) ..... 10-2018-0158352

(51) Int. Cl.

| | |
|---|---|
| ***H01R 13/68*** | (2011.01) |
| ***H01H 85/02*** | (2006.01) |
| ***H01H 85/20*** | (2006.01) |
| ***H01R 13/502*** | (2006.01) |
| ***H01R 24/28*** | (2011.01) |
| *H01R 103/00* | (2006.01) |

(52) U.S. Cl.

CPC ..... *H01R 13/68* (2013.01); *H01H 85/0241* (2013.01); *H01H 85/205* (2013.01); *H01R 13/502* (2013.01); *H01R 24/28* (2013.01); *H01R 2103/00* (2013.01)

(58) Field of Classification Search

CPC ..... H01R 13/68; H01R 13/502; H01R 24/28; H01R 2103/00; H01R 13/707; H01R 13/5202; H01R 13/688; H01R 13/684; H01H 85/0241; H01H 85/205

USPC ..... 337/198, 237, 264

See application file for complete search history.

(56) References Cited

U.S. PATENT DOCUMENTS

| | | | | |
|---|---|---|---|---|
| 6,746,279 | B1 * | 6/2004 | Lopez | H01R 9/2458 439/620.01 |
| 7,789,690 | B1 * | 9/2010 | Rhein | H01R 13/53 439/310 |
| 9,099,815 | B2 * | 8/2015 | Kashiwada | H01R 13/688 |
| 9,698,543 | B2 * | 7/2017 | Kato | H01R 13/688 |
| 9,768,600 | B1 * | 9/2017 | Kato | H01R 13/688 |
| 10,218,130 | B1 * | 2/2019 | Jung | H01M 2/305 |

(Continued)

FOREIGN PATENT DOCUMENTS

| | | |
|---|---|---|
| KR | 2012-0061822 A | 6/2012 |
| KR | 2013-0094831 A | 8/2013 |

*Primary Examiner* — Stephen S Sul

(74) *Attorney, Agent, or Firm* — McDonnell Boehnen Hulbert & Berghoff LLP

(57) ABSTRACT

A junction connector assembly integrated with a fuse may include an inner housing having a 1-1-th bus bar, a 1-2-th bus bar, and a second bus bar disposed therein to be spaced apart from one another and a first opening portion formed on one side surface to protrude first terminal portions of the 1-1-th bus bar and the 1-2-th bus bar; and a fuse configured to electrically connect the 1-1-th bus bar and the 1-2-th bus bar to each other, the fuse being inserted and fixed into the first opening portion.

12 Claims, 10 Drawing Sheets

(56) References Cited

U.S. PATENT DOCUMENTS

| | | | | |
|---|---|---|---|---|
| 2009/0023334 | A1* | 1/2009 | Puschkat | H01H 85/044 439/590 |
| 2009/0149048 | A1* | 6/2009 | Pavlovic | B60L 3/0069 439/181 |
| 2010/0124834 | A1 | 5/2010 | de Chazal | |
| 2010/0279555 | A1* | 11/2010 | Azad | H01R 13/514 439/676 |
| 2011/0151719 | A1* | 6/2011 | DeWitte | B60L 53/16 439/620.26 |
| 2012/0094537 | A1* | 4/2012 | Aoki | H01R 13/688 439/620.26 |
| 2012/0108106 | A1 | 5/2012 | de Chazal | |
| 2014/0185194 | A1* | 7/2014 | Mills | H05K 7/20409 361/624 |
| 2017/0327064 | A1* | 11/2017 | Leverett, Jr. | B60R 16/033 |
| 2018/0083375 | A1* | 3/2018 | Matsumura | H01R 9/226 |
| 2018/0145463 | A1* | 5/2018 | Kiyuna | H01R 13/68 |
| 2019/0356121 | A1* | 11/2019 | Shiraki | H01M 2/348 |
| 2020/0153173 | A1* | 5/2020 | Kurita | B60L 53/16 |
| 2020/0169011 | A1* | 5/2020 | Kurita | H01R 9/22 |

* cited by examiner

JUNCTION CONNECTOR ASSEMBLY INTEGRATED WITH FUSE

CROSS-REFERENCE TO RELATED APPLICATION

This application claims priority to Korean Patent Application No. 10-2018-0158352 filed on Dec. 10, 2018, which is incorporated herein by reference in its entirety.

BACKGROUND OF THE DISCLOSURE

Field of the Disclosure

The present disclosure relates to a junction connector assembly, and more particularly, to a junction connector assembly integrated with a fuse, in which a circuit is provided in a connector and the fuse is assembled.

Description of Related Art

Generally, an in-line fused connector has been known. The in-line fused connector includes an outside housing provided with a front end portion and a fuse assembly. Such an in-line fused connector is configured in such a manner that the fuse is assembled to the fuse subassembly and then coupled to the outside housing.

Particularly, the fuse subassembly has a structure in which the outside housing is disposed and the fuse is detachable from the fuse assembly through the front end portion of the outside housing.

However, in a case of such an in-line fused connector, in order to perform reworking operation after fuse breakage, it is possible to replace the fuse after releasing a matching terminal connected to the fuse and disassembling the fuse subassembly from the outside housing.

Since the release of the matching terminal and disassembly of the subassembly are required for the fuse replacement, it is difficult to replace the fuse and it should be careful not to cause the impact and/or the deformation to the matching terminal during replacing the fuse.

In addition, there is no separate circuit in the connector, so that supplied power is branched and the connection with the connector is not possible.

SUMMARY

The present disclosure has been made to solve the above problems and an object of the present disclosure is to provide a junction connector assembly integrated with a fuse, which is capable of fixing the fuse without a separate subassembly, easily performing a rework operation of the fuse, and replacing the fuse without releasing a matching terminal.

Another object of the present disclosure is to provide a junction connector assembly integrated with a fuse, in which supplied power is branched and to which other units and a connector are capable of connecting.

In order to achieve the above-described problems, the present disclosure provides a junction connector assembly integrated with a fuse, which is capable of fixing the fuse without a separate subassembly, easily performing a rework operation of the fuse, and replacing the fuse without releasing a matching terminal.

The junction connector assembly integrated with a fuse includes an inner housing having a 1-1-th bus bar, a 1-2-th bus bar, and a second bus bar disposed therein to be spaced apart from one another and a first opening portion formed on one side surface to protrude first terminal portions of the 1-1-th bus bar and the 1-2-th bus bar, and a fuse configured to electrically connect the 1-1-th bus bar and the 1-2-th bus bar to each other, the fuse being inserted and fixed into the first opening portion.

In addition, a second opening portion for fixing and fastening the 1-1-th bus bar and the 1-2-th bus bar to a wire terminal connected to an external power supply is formed in the inner housing.

In addition, a front end portion for connecting with the connector may be formed at one end of the inner housing, a rear end portion for inserting the wire terminal may be formed at the other end of the inner housing, and a side end portion for connecting with a unit may be formed on an opposite side of the second opening portion.

In addition, second terminals of the 1-2-th bus bar and the second bus bar may protrude in the front end portion.

In addition, the second terminals may be plug shapes.

In addition, third terminals of the 1-1-th bus bar and the second bus bar may be exposed at the side end portion.

In addition, an inner seal for waterproofing may be assembled to the side end portion.

In addition, a shield case may be assembled to the rear end portion.

In addition, the junction connector assembly integrated with a fuse may further include first and second interlock bus bars configured to disconnect an interlock connection to shut off the power when the connector is separated for replacing the fuse.

In addition, the 1-1-th bus bar, the 1-2-th bus bar, and the second bus bar may be fixed into the inner housing by insert injection molding.

In addition, a fuse cover detachable from the first opening portion for preventing the fuse may include a fuse cover body, and a fuse cover seal inserted into the fuse cover body to prevent moisture from entering the fuse cover body.

In addition, an inner cover detachable from the second opening portion may include an inner cover body, and an inner cover seal inserted into the inner cover body to prevent moisture from entering the inner cover body.

In addition, an outer cover may be assembled to first and second outer housings assembled to both ends of the inner housing.

In addition, first and second guides may be formed on one side surface of the first and second outer housings respectively so that the outer cover is guided and assembled.

In addition, a bolt fixing projection may be formed on the other side surface of the first and second outer housings so that an outer cover wing of the outer cover is assembled to surround the bolt fixing projection.

According to the present disclosure, the junction connector assembly integrated with a fuse, in which the circuit is provided in the connector and the fuse is assembled, so that a separate high voltage box is unnecessary and it is effective to reduce and simplify the size, and to lighten the weight.

In addition, another effect of the present disclosure is that it is possible to fix the fuse without a separate subassembly and to replace the fuse without releasing the matching terminal.

In addition, still another effect of the present disclosure is that a separated fuse cover and the outer cover are assembled, so that it is possible to perform the fuse replacement operation only by the disassembly of the outer cover and the fuse cover, thereby increasing ease of operation and efficiency.

In addition, still another effect of the present disclosure is that the assembled connector should be separated first in order to separate the outer cover at the time of replacing the fuse, when the connector is separated for the fuse replacement, the interlock connection is disconnected and power is shut off, so that it is effective to prevent safety accident.

DESCRIPTION OF SPECIFIC EMBODIMENTS

Figure 1:
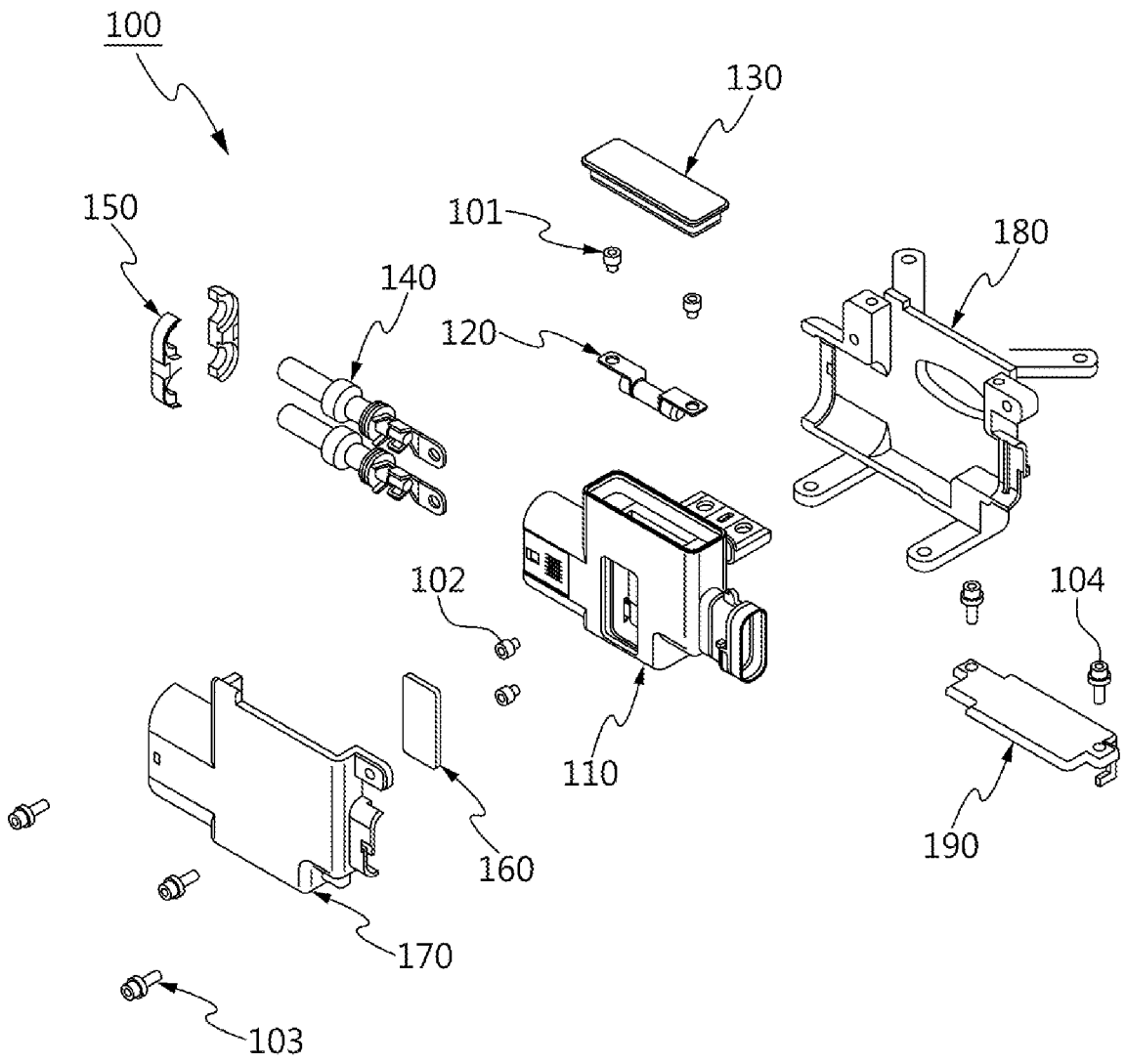
FIG. 1 is an exploded perspective view of a junction connector assembly integrated with a fuse according to one embodiment of the present disclosure.

The above-described objects, characteristics, and advantages will be described below in more detail with reference to the accompanying drawings, accordingly, those skilled in the art in the technical field to which the present disclosure pertains can easily implement the technical idea of the present disclosure. If it is determined that a specific description of the related art in the following description of the present disclosure may unnecessarily obscure the subject matter of the present disclosure, a detailed description thereof will be omitted.

Hereinafter, a preferred embodiment according to the present disclosure will be described in detail with reference to the accompanying drawings. In the drawings, the same reference numerals are used to denote the same or similar elements.

FIG. 1 is an exploded perspective view showing a junction connector assembly 100 integrated with a fuse according to one embodiment of the present disclosure. With reference to FIG. 1, the junction connector assembly 100 integrated with a fuse fixes a fuse 120 onto an upper surface of an inner housing 110 with first bolts 101 and assembles a fuse cover 130 to the fuse 120. In addition, a wire terminal 140 is fixed onto a side surface of the inner housing 110 with second bolts 102, and then a rear holder 150 and an inner cover 160 are assembled.

After the fuse 120 and the wire terminal 140 are assembled, a first outer housing 170 and a second outer housing 180 are assembled onto the both side surfaces of the inner housing 110. The first outer housing 170 and the second outer housing 180 are fixed onto the both side surfaces of the inner housing 110 with a third bolts 103.

When the first outer housing 170 and the second outer housing 180 are assembled, finally, an outer cover 190 is assembled to the first outer housing 170 and the second outer housing 180 and fixed them with fourth bolts 104.

Figure 2:
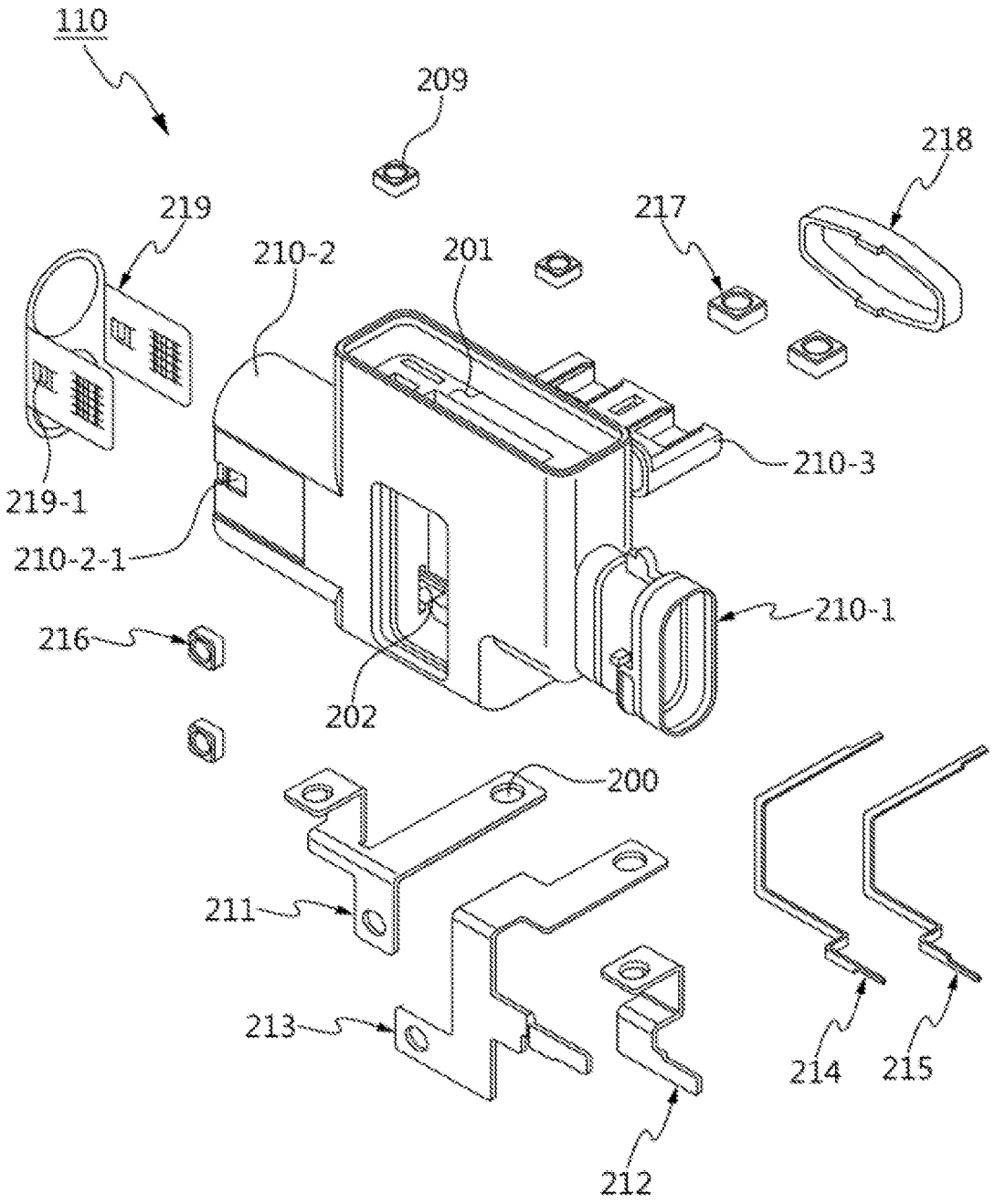
FIG. 2 is a perspective view showing a detailed configuration of an inner housing illustrated in FIG. 1.

FIG. 2 is a perspective view showing a detailed configuration of an inner housing illustrated in FIG. 1. Referring to FIG. 2, a 1-1-th bus bar 211, a 1-2-th bus bar 212, and a second bus bar 213 are disposed to be spaced apart from one another in the inner housing 110. In addition, a first opening portion 201 is formed on an upper side surface of the inner housing 110 so as to protrude one ends of the 1-1-th bus bar 211 and the 1-2-th bus bar 212. In addition, a second opening portion 202 is formed on a left side surface of the inner housing 110 so as to dispose one ends of the wire terminal 140, the 1-1-th bus bar 211, and the second bus bar 213 in an overlapping manner and to fix them with the second bolts 102.

In addition, a front end portion 210-1 is formed at a front end of the inner housing 110 in order to connect with an external connector (not illustrated), a rear end portion 210-2 is formed at a rear end of the inner housing 110 in order to insert the wire terminal 140 connected to an external power supply, and a side end portion 210-3 is formed on an opposite side of the second opening portion 202 in order to connect with other units.

The side end portion 210-3 is a plate shape and distal ends of the 1-1-th bus bar 211 and the second bus bar 213 are exposed to the outside. An inner seal 218 for waterproofing is assembled to the side end portion 210-3 to prevent external moisture from entering the unit. As a material of the inner seal 218, rubber, silicone, or the like may be used for waterproofing.

A shield case 219 is inserted and assembled to the rear end portion 210-2. Generally, the shield case 219 performs a function of shielding electromagnetic waves. As a material of the shield case 219, a nickel-silver alloy (Ni-silver), a galvanized plate, a cold-rolled plate, or the like may be used. Particularly, the electromagnetic waves are shielded between the wire terminal 140 and the first outer housing 170 and the second outer housing 180.

For easy fastening, only some portions are connected to the shield case 219 and a bent fastening portion 219-1 is formed at the remaining portions which are not connected to the shield case 219 to form a fastening groove 210-2-1 at the rear end portion 210-2. Particularly, a cross section of the shield case 219 may be a "Π" shape.

A through hole 200 is formed at each of the 1-1-th bus bar 211, the 1-2-th bus bar 212, and the second bus bar 213, first and third bolts 101 and 103 are inserted into the through hole 200 and coupled to first and third nuts 209 and 216, so as to be press-fitted and fixed to the through hole 200. Naturally, the first and third nuts 209 and 216 are disposed together on the back side of the 1-1-th bus bar 211, the 1-2-th bus bar 212, and the second bus bar 213 when the inner housing 110 is insert injection molded.

Therefore, as a material of the inner housing 110, an insulating silicone resin, an alkyd resin, an epoxy resin, a polyurethane resin, a polyester resin, a melamine resin, an acrylic resin, or the like may be used.

As a material of the 1-1-th bus bar 211, the 1-2-th bus bar 212, and the second bus bar 213, copper, brass, zinc, aluminum, or the like may be used.

In addition, third nuts 217 may be fixed to the side end portion 210-3 at the time of the insert injection molding and inserted into the side end portion 210-3 after completing the insert injection molding.

Referring to FIG. 2, when the connector is separated in order to replace the fuse (120 in FIG. 1), first and second interlock bus bars 214 and 215 are configured to disconnect the interlock connection to shut off power.

The nuts 216, 217, and 209 are illustrated as a square nut, but are not limited to this, and nuts with other shapes may be also used.

Figure 3:
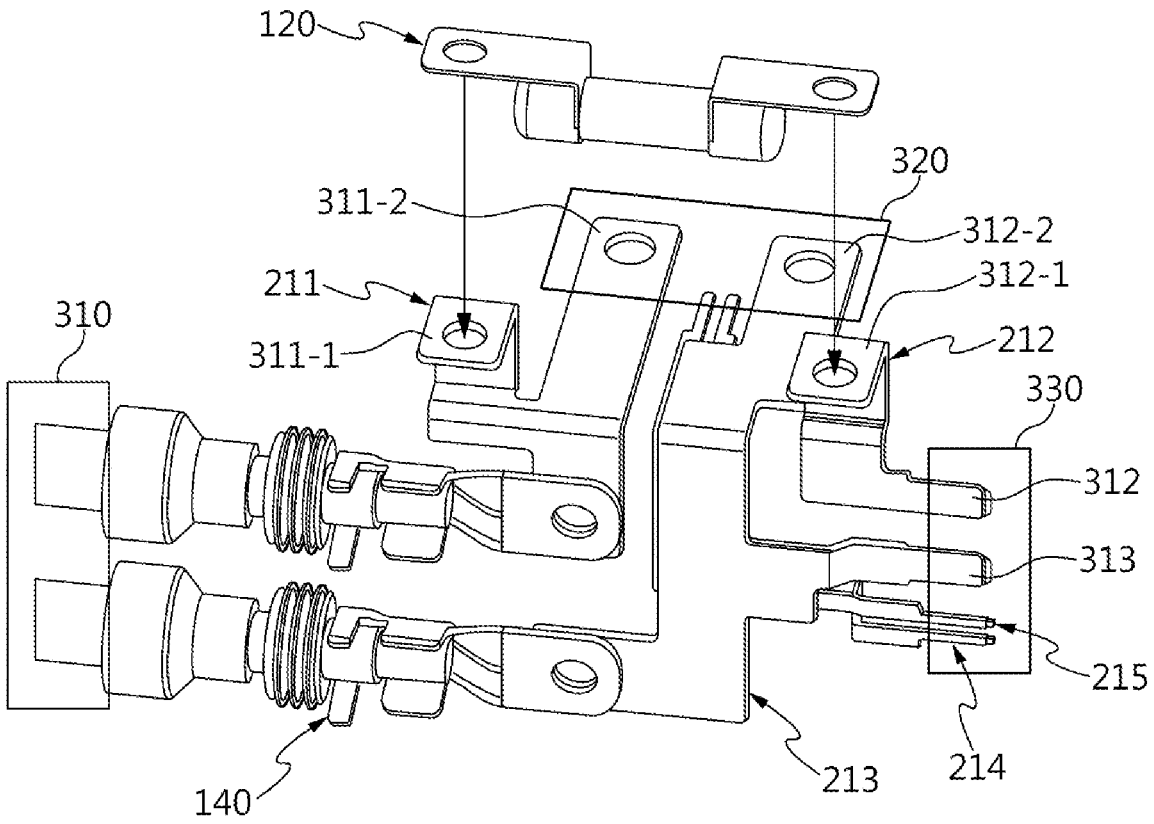
FIG. 3 is a perspective view showing an internal connection structure of the inner housing illustrated in FIG. 1.
Figure 4:
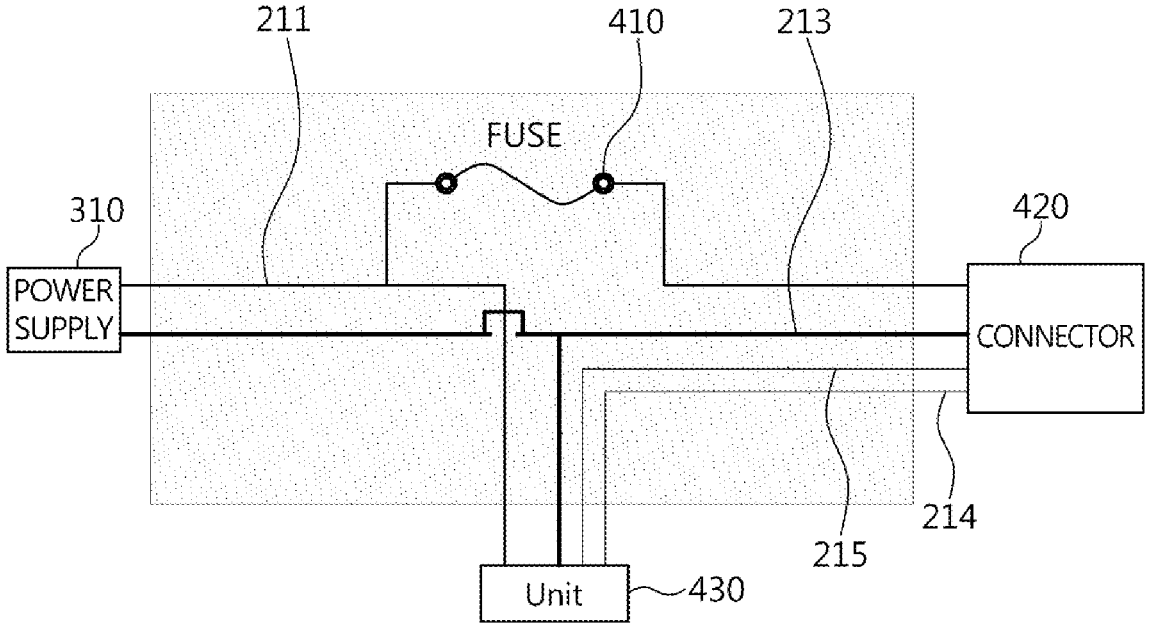
FIG. 4 is an equivalent circuit diagram of the internal connection structure illustrated in FIG. 3.

FIG. 3 is a perspective view showing an internal connection structure of the inner housing 110 illustrated in FIG. 1, and FIG. 4 is an equivalent circuit diagram of the internal connection structure illustrated in FIG. 3. Referring to FIGS. 3 and 4, power from a power supply 310 delivered through the wire terminal 140 is branched into two through the 1-1-th bus bar 211 and the second bus bar 213 and the power supply 310 is divided into the fuse 120 and a unit 430 respectively. In addition, the fuse 120 is assembled with the 1-2-th bus bar 212 and the power delivered through the fuse 120 is connected to the connector 420.

Additionally, a positive (+) power supply supplied through the wire terminal 140 is branched into two and the branched power supplies are connected to the unit 430 and the fuse 120 respectively. The positive (+) power supply delivered through the fuse 120 is connected to the connector 420. A negative (−) power supply is also branched into two and the branched power supplies are directly connected to the unit 430 and the connector 420 respectively.

The unit 430 and the connector 420 have a structure in which the unit 430 and the connector 420 are connected to an interlock circuit (not illustrated) through the first and second interlock bus bars 214 and 215.

Additionally, third terminals 311-2 and 312-2 of the 1-1-th bus bar 211 and the second bus bar 213 and distal ends of the first and second interlock bus bars 214 and 215 are exposed to a unit connection part 320. Meanwhile, second terminals 312 and 313 of the 1-2-th bus bar 212 and the second bus bar 213 and the distal ends of the first and second interlock bus bars 214 and 215 protrude from a connector connection part 330. These second terminals 312 and 313 are plug shape.

Referring to FIG. 4, when the connector 430 is separated in order to replace the fuse (120 in FIG. 1), the first and second interlock bus bars 214 and 215 are configured to disconnect the interlock connection to shut off power from the power supply 310. Therefore, it is effective to prevent safety accident.

Figure 5:
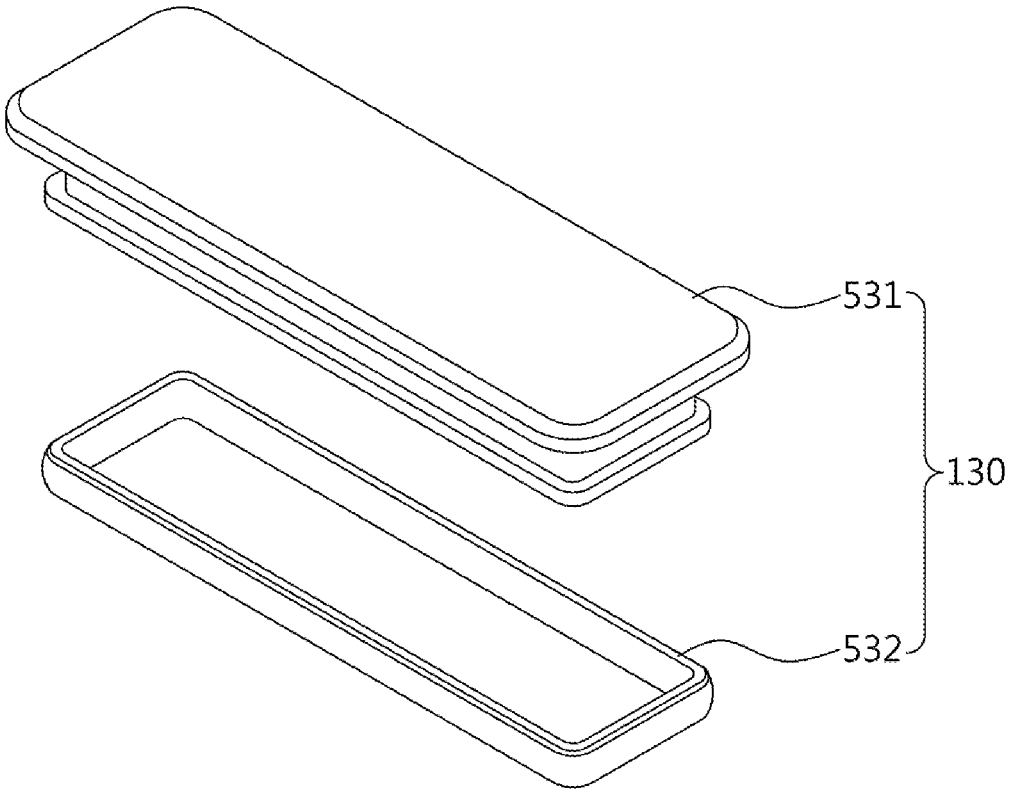
FIG. 5 is a perspective view of a fuse cover according to one embodiment of the present disclosure.

FIG. 5 is a perspective view of the fuse cover 130 according to one embodiment of the present disclosure. Referring to FIG. 5, the fuse cover 130 includes a fuse cover body 531 and a fuse cover seal 532 inserted into the fuse cover body 531 to prevent moisture from entering the fuse cover body 531. The fuse cover seal 532 prevents the moisture from entering the inside of the inner housing 110 after the fuse 120 is assembled.

Figure 6:
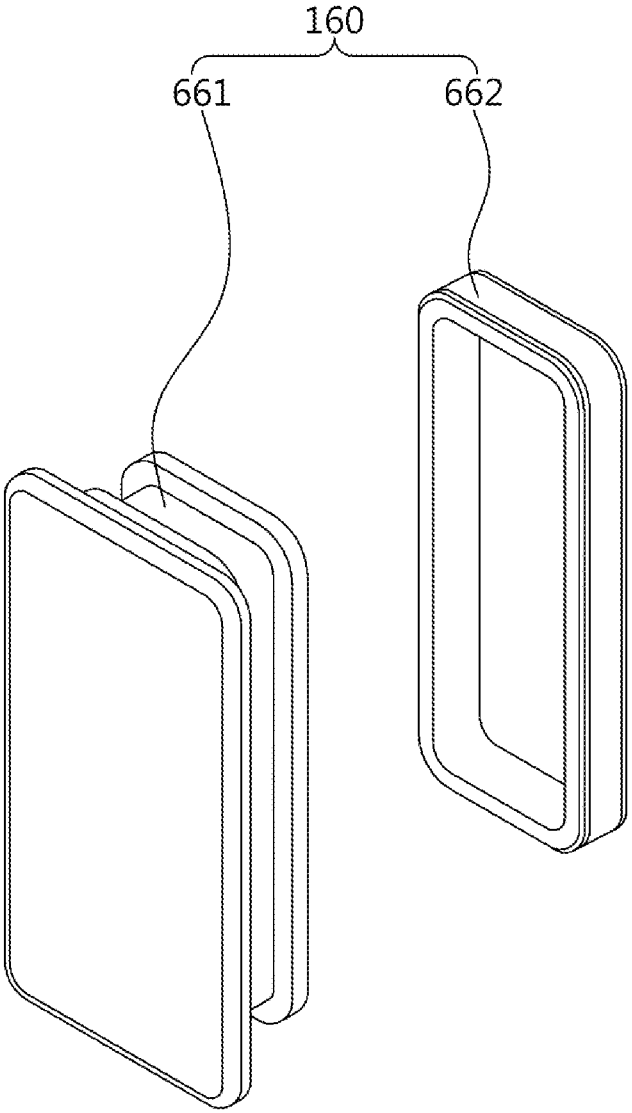
FIG. 6 is a perspective view of an inner cover according to one embodiment of the present disclosure.

FIG. 6 is a perspective view of the inner cover 160 according to one embodiment of the present disclosure. Referring to FIG. 6, the inner cover 160 is provided with an inner cover body 661 and an inner cover seal 662 inserted into the inner cover body 661 to prevent external moisture from entering the inner cover body 661. The inner cover seal 662 prevents the moisture from entering the inside of the inner housing 110 after the wire terminal 140 is assembled.

Figure 7:
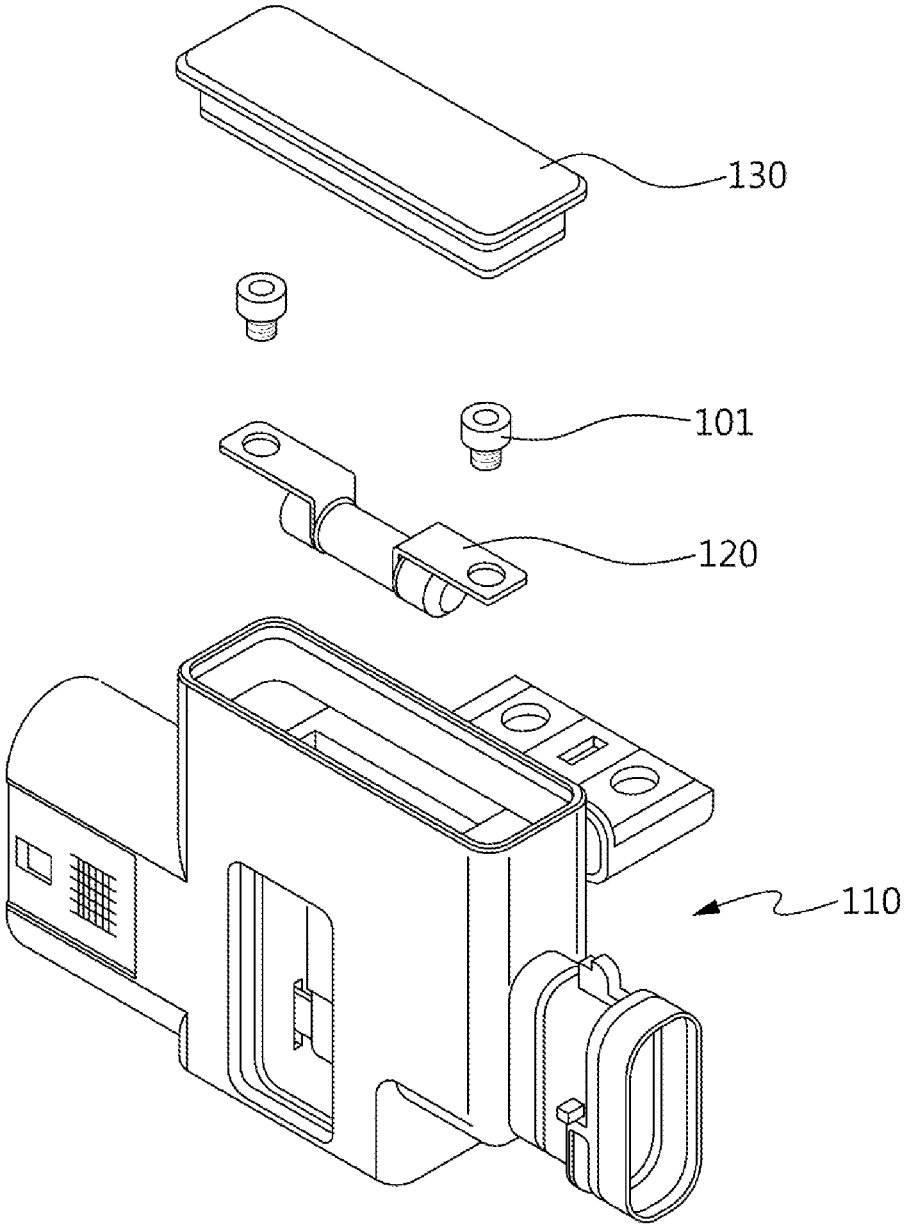
FIG. 7 is a perspective view showing an assembly of a fuse into the inner housing illustrated in FIG. 1.

FIG. 7 is a perspective view showing an assembly of the fuse 120 into the inner housing 110 illustrated in FIG. 1. Referring to FIG. 7, the fuse 120 is assembled into the first opening portion (201 in FIG. 2) of the inner housing 110 and the bolts 101 are fastened to the nuts 209 to fix the fuse 120. After the fuse 120 is fixed with the bolts 101, the fuse cover 130 is assembled to prevent the moisture from entering the inside of the inner housing 110.

Figure 8:
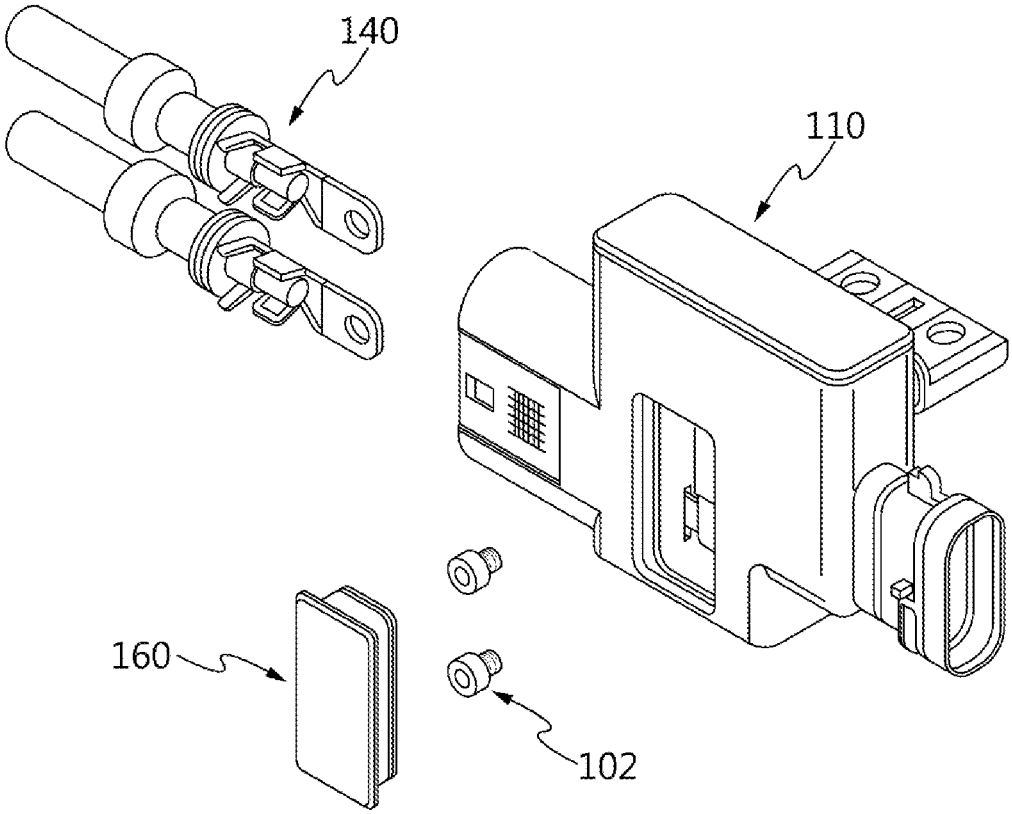
FIG. 8 is a perspective view showing an assembly of a wire terminal to the inner housing illustrated in FIG. 1.

FIG. 8 is a perspective view showing an assembly of the wire terminal 140 to the inner housing 110 illustrated in FIG. 1. Referring to FIG. 8, it is a structure in which the wire terminal 140 is assembled to the inner housing 110 and the bolts 102 are fastened to the nuts to fix the wire terminal 140. After the wire terminal 140 is fixed with the bolts 102, the inner cover 160 is assembled to prevent the moisture from entering the inside of the inner housing 110.

Figure 9:
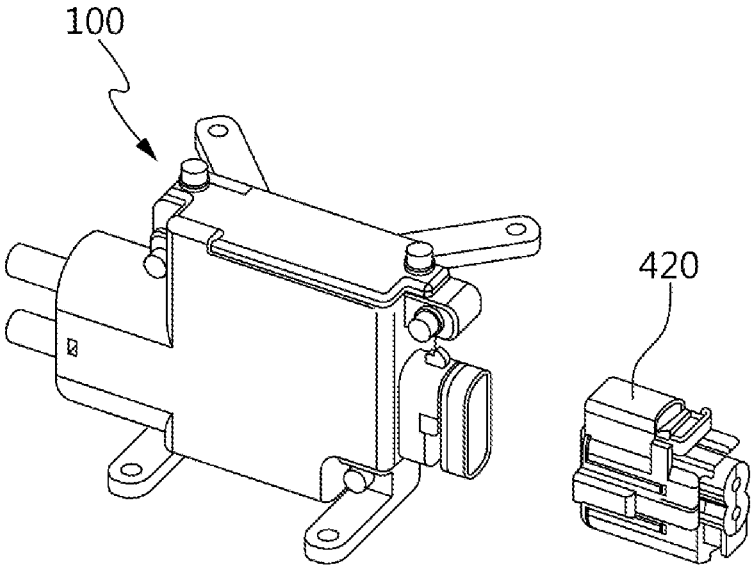
FIGS. 9, 10, 11, and 12 are views showing a process of fuse replacement according to one embodiment of the present disclosure.

FIGS. 9 to 12 are views showing a process of fuse replacement according to one embodiment of the present disclosure. When replacing the fuse 120 in the high voltage junction connector assembly 100 integrated with a fuse, firstly, the connected connector 420 is separated as illustrated in FIG. 9.

Figure 10:
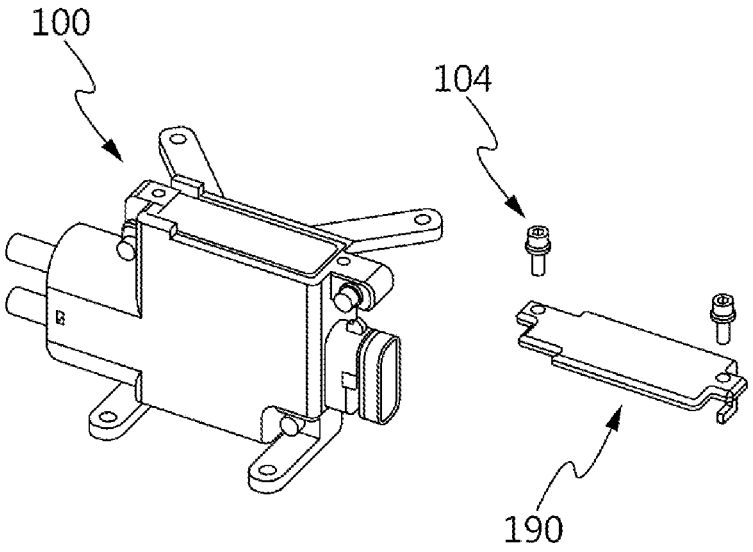

As the connector 420 is separated, the connection with the interlock circuit is disconnected and the power is shut off After the connector 420 is separated, the bolts 104 are released and the outer cover 190 is separated as illustrated in FIG. 10.

Figure 11:
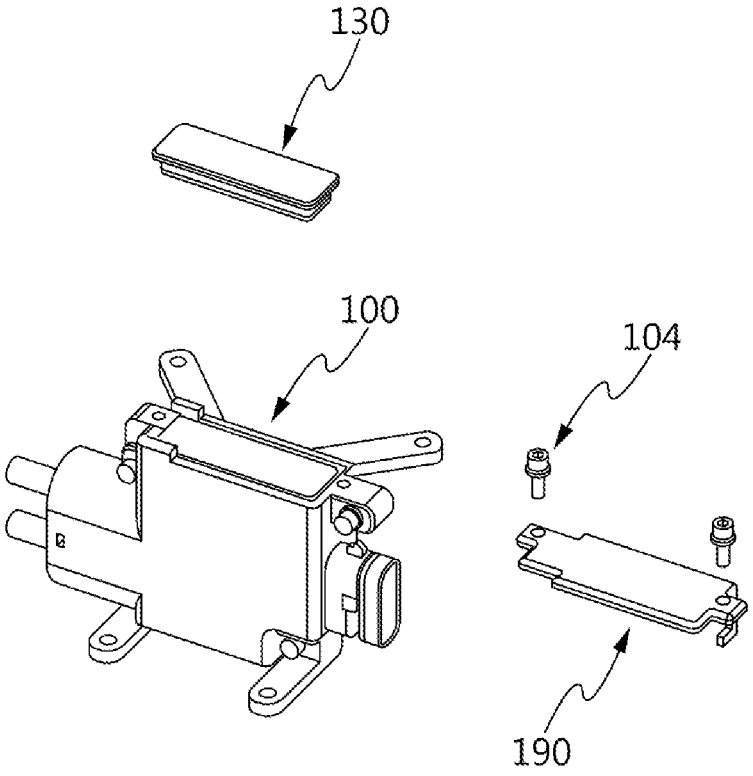
Figure 12:
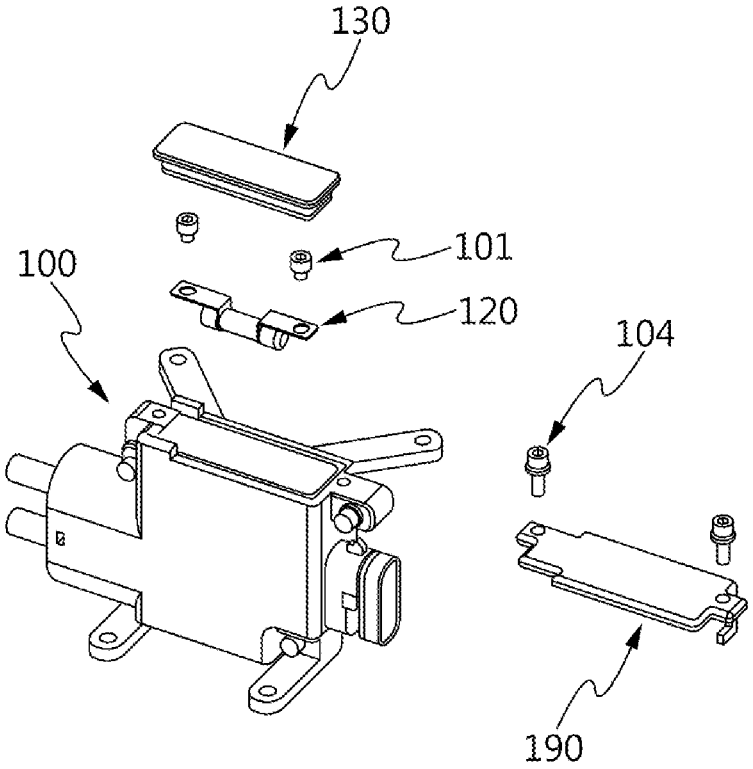

As illustrated in FIG. 11, the fuse cover 130 is separated after the outer cover 190 is separated. As illustrated in FIG. 12, the bolts 101 are released and the fuse 120 is replaced after the fuse cover 130 is separated. After replacing the fuse 120, the junction connector assembly 100 is assembled in reverse order of the above method.

Figure 13:
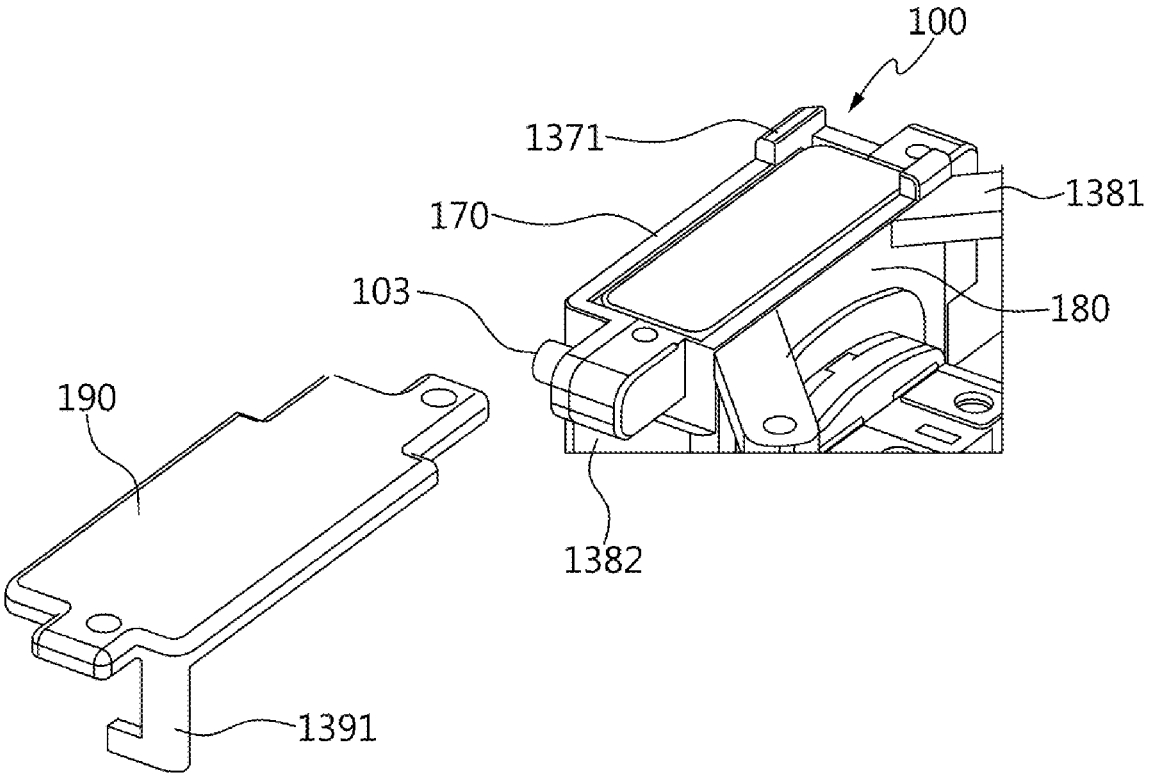
FIG. 13 is a perspective view showing an assembly of an outer cover according to one embodiment of the present disclosure.

FIG. 13 is a perspective view showing an assembly of the outer cover 190 according to one embodiment of the present disclosure. Referring to FIG. 13, the first outer housing 170 and the second outer housing 180 are assembled to the inner housing 110 and the outer cover 190 is assembled to the high voltage junction connector assembly 100 integrated with a fuse fixed with the bolts 103. At this time, the outer cover 190 is guided and assembled between a first guide 1371 formed on the first outer housing 170 and a second guide 1381 formed on the second outer housing 180, and an outer cover wing 1391 is assembled to surround a bolt fixing projection 1382.

When the first outer housing 170 and the second outer housing 180 are matched with each other, the bolt fixing projection 1382 is formed on an upper side surface.

Figure 14:
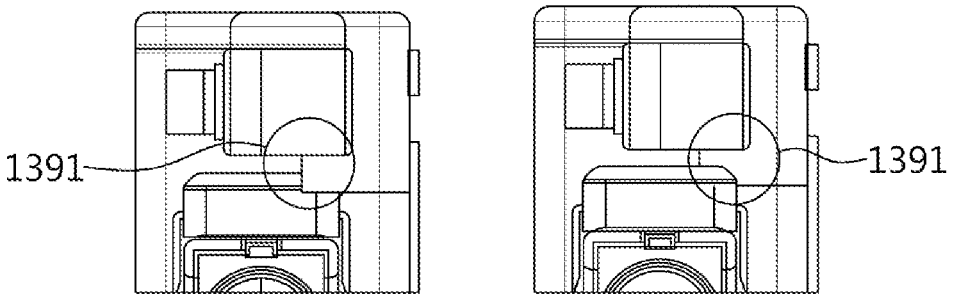
FIG. 14 is a front view of the junction connector assembly integrated with a fuse according to FIG. 13.

FIG. 14 is a front view of the junction connector assembly 100 integrated with a fuse according to FIG. 13. Referring to FIG. 14, when the connector 420 is fastened to the high voltage junction connector assembly 100 integrated with a fuse, the assembled connector 420 is positioned on the outer cover wing 1391 of the outer cover 190.

In order to disassemble the outer cover 190, it should be separated the connector 420 first since the outer cover 190 is not possible to disassemble without separating the connector by interference of the outer cover wing 1391 and the assembled connector.

What is claimed is:

1. A junction connector assembly integrated with a fuse, comprising:

an inner housing having a 1-1-th bus bar, a 1-2-th bus bar, and a second bus bar disposed therein to be spaced apart from one another and a first opening portion formed on one side surface to protrude first terminal portions of the 1-1-th bus bar and the 1-2-th bus bar; and the fuse configured to electrically connect the 1-1-th bus bar and the 1-2-th bus bar to each other, the fuse being inserted and fixed into the first opening portion;

wherein a second opening portion for fixing and fastening the 1-1-th bus bar and the 1-2-th bus bar to a wire terminal connected to an external power supply is formed in the inner housing; and wherein a front end portion for connecting with a connector is formed at one end of the inner housing, a rear end portion for inserting the wire terminal is formed at an other end of the inner housing, and a side end portion for connecting with a unit is formed on an opposite side of the second opening portion.

2. The junction connector assembly integrated with the fuse according to claim 1, wherein second terminals of the 1-2-th bus bar and the second bus bar protrude in the front end portion.

3. The junction connector assembly integrated with the fuse according to claim 2, wherein the second terminals are plug shaped.

4. The junction connector assembly integrated with the fuse according to claim 1, wherein third terminals of the 1-1-th bus bar and the second bus bar are exposed at the side end portion.

5. The junction connector assembly integrated with the fuse according to claim 4, wherein an inner seal for waterproofing is assembled to the side end portion.

6. The junction connector assembly integrated with the fuse according to claim 1, wherein a shield case is assembled to the rear end portion.

7. The junction connector assembly integrated with the fuse according to claim 1, further comprising:

first and second interlock bus bars configured to disconnect an interlock connection to shut off power when the connector is separated for replacing the fuse.

8. The junction connector assembly integrated with the fuse according to claim 1, wherein the 1-1-th bus bar, the 1-2-th bus bar, and the second bus bar are fixed into the inner housing by insert injection molding.

9. The junction connector assembly integrated with the fuse according to claim 1, further comprising a fuse cover detachable from the first opening portion, wherein the fuse cover includes:

a fuse cover body, and a fuse cover seal inserted into the fuse cover body to prevent moisture from entering the fuse cover body.

10. The junction connector assembly integrated with the fuse according to claim 1, wherein an inner cover detachable from the second opening portion includes an inner cover body, and an inner cover seal inserted into the inner cover body to prevent moisture from entering the inner cover body.

11. The junction connector assembly integrated with the fuse according to claim 1, wherein an outer cover is assembled to first and second outer housings assembled to both ends of the inner housing.

12. The junction connector assembly integrated with the fuse according to claim 11, wherein first and second guides are formed on one side surface of the first and second outer housings respectively so that the outer cover is guided and assembled, and a bolt fixing projection is formed on the other side surface of the first and second outer housings so that an outer cover wing of the outer cover is assembled to surround the bolt fixing projection.

* * * * *